United States Patent [19]

Story, Jr.

[11] 4,090,532

[45] May 23, 1978

[54] TIMER CONTROLLED VALVE

[75] Inventor: J. Albert Story, Jr., La Puente, Calif.

[73] Assignee: Cla-Val Co., Costa Mesa, Calif.

[21] Appl. No.: 747,532

[22] Filed: Dec. 6, 1976

[51] Int. Cl.[2] ..... G05G 21/00

[52] U.S. Cl. ..... 137/624.15; 137/624.2; 251/131

[58] Field of Search ..... 137/624.13, 624.15, 137/624.18, 624.2; 251/130, 131

[56] References Cited

U.S. PATENT DOCUMENTS

| | | | |
|---|---|---|---|
| 2,580,122 | 12/1951 | Parker | 251/130 |
| 3,520,332 | 7/1970 | Willard | 137/624.13 |

*Primary Examiner*—Alan Cohan

*Attorney, Agent, or Firm*—Gausewitz, Carr & Rothenberg

[57] ABSTRACT

A self-contained battery-operated three-way control valve is repetitively cycled by a clock timer for cyclical control of an automatic hydraulic valve. The control valve is driven to one or the other of two limit positions by a reversible motor under control of forward and reverse motor circuits that are sequentially energized by a timer and de-energized by limit switches. A reverse control, also operated by the timer, selects one or the other of the motor circuits.

23 Claims, 14 Drawing Figures

TIMER CONTROLLED VALVE

BACKGROUND OF THE INVENTION

The present invention relates to timed control devices and more particularly concerns a time regulated controller for automatic valves.

Various types of automatically operated devices are provided with controllers that regulate operation according to some remotely derived command or timed program. Among the many different types of automatically controlled devices are automatic valves employed for control of fluid flow. For example, the automatic valve known as the Clayton 100 Hytrol Valve, manufactured by Cla-Val Company of Newport Beach, Calif., is capable of use in all types of piping systems requiring remote control, pressure regulation, solenoid operation, rate of flow control, liquid level control or check valve operation. Valves of this type, employed in anti-surge pumping systems, are described in U.S. Pat. Nos. 2,384,420 and 3,957,395. Basically in this type of valve, a main fluid flow opening is provided with a valve seat that is closed by a valve closure member, which in turn is operated by a diaphragm positioned in a pressure chamber. Closing and opening of the valve is achieved by control of pressure within the diaphragm chamber.

These automatic valves are commonly operated by solenoid controlled pilot valves that provide a relatively high pressure to one side of the diaphragm to drive the closure member into closed position or provide a lower pressure to this side of the diaphragm, allowing normal fluid pressure to move the closure member to open position. For automatic time programmed operation, conventional timers are employed to operate electrical circuits that control the pilot valve solenoid, switching the solenoid between energized and deenergized conditions to provide pressure to the diaphragm for actuating the main valve.

The solenoid requires electrical power to hold it in one condition and thus in addition to the excess use of power, is subject to possible failure of holding circuits to maintain a selected position of the controlled valve.

Timing devices commonly employed also require holding circuits or holding components in the timer to maintain the circuits in one condition or the other during the intervals between preselected times of operation.

Compact, reliable and self-contained timer regulated valve controllers have not heretofore been available.

Accordingly it is an object of the present invention to provide an improved controller for automatic time regulated actuation.

DETAILED DESCRIPTION

Controllers of the type described herein will find utility in a wide variety of applications wherein remote actuation of an apparatus is to be accomplished in some selected chronological pattern or time program. However, since the invention has been initially mechanized for use in timed control of an automatic flow control valve, a specific embodiment will be described for such use.

Figure 1:
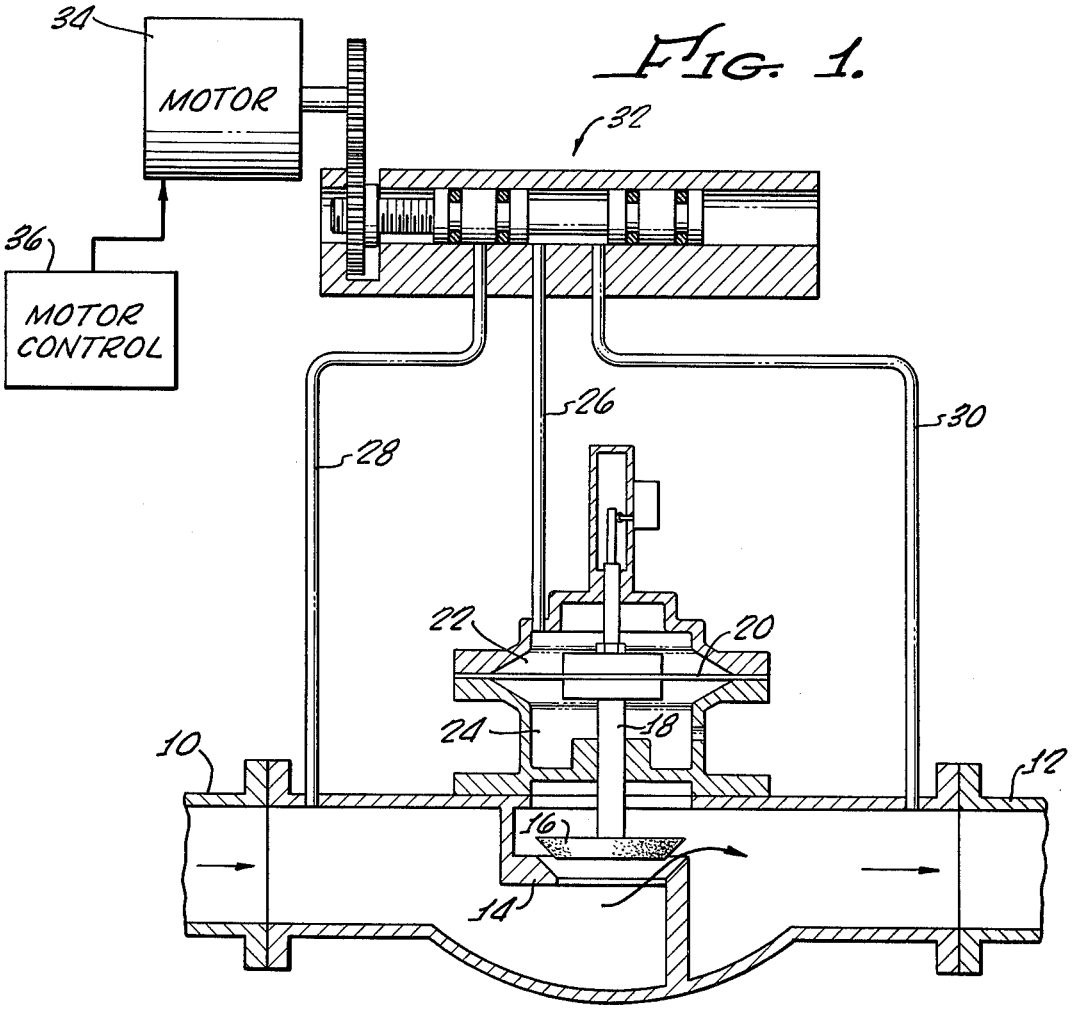
FIG. 1 illustrates a time regulated controller connected to control an automatic diaphragm operated valve.

As shown in FIG. 1, an automatic diaphragm operated valve of the type shown in U.S. Pat. Nos. 2,384,420 and 3,957,395 controls flow of fluid from an upstream pipe 10 to a downstream pipe 12 by means of a valve seat 14 that cooperates with a movable valve closure member 16. The latter is operated by a valve shaft 18 coupled to a flexible diaphragm 20 that is driven either upwardly or downwardly, as viewed in FIG. 1, in accordance with the pressure differential in first and second valve operating chambers 22, 24 on either side of the diaphragm 20. Pressure in chamber 22 is employed to operate the valve 14, 16 and is regulated by connection of chamber 22 with either a relatively high pressure at the upstream side of the valve or a relatively low pressure at the downstream side of the valve. To this end a common conduit 26, connected for communication with valve chamber 22, is selectively coupled, by the controller of the present invention, to either a pressure conduit 28, connected to the upstream side of valve 14, 16, or a drain conduit 30, connected to the downstream or low pressure side of valve 14, 16.

The timed controller of the present invention is operable to connect the common conduit 26 with either the pressure conduit 28 or the drain conduit 30 according to a pre-selected time program. When conduits 26 and 28 are connected to each other, high pressure in diaphragm chamber 22 closes the valve 14, 16. When conduits 26 and 30 are interconnected, a low pressure in chamber 22 allows the upstream pressure in pipe 10 to open the valve 14, 16.

The timed controller of the present invention is schematically shown in FIG. 1 and includes a miniature three-port, two-position spool type pilot valve 32, a reversible motor 34 to reciprocate the pilot valve spool, and a timed motor control 36.

The valve spool is reciprocated under control of the motor between a first position in which conduits 26 and 28 are interconnected while conduit 30 is blocked, and a second position in which conduits 26 and 30 are interconnected while conduit 28 is blocked.

The pilot valve motor is a reversible motor, driven either in one direction or the other, under control of a timer with final valve positions being defined by a dual limit switch. As functionally illustrated in FIG. 2, pilot valve 32 is connected to operate a limit switch mechanism 38 which is connected in first and second, or forward and reverse, motor control circuits 40, 42. A timer 44 is connected to energize the two motor circuits, one after the other. Upon energization of the reverse circuit 42 by the timer, a motor reverse control 46 is simultaneously operated to enable the reverse circuit and to disable the forward circuit.

Initially, both motor circuits are disabled or deenergized. The timer is provided with first and second actuators, described more particularly below, of which the first will initially energize the forward motor circuit 40 to operate the motor and move the valve spool toward a forward limit position. Upon reaching the forward limit position, limit switch 38 opens the forward motor circuit and the controller remains in this condition until the second timer actuator is driven to energize the reverse circuit 42. Concommitantly, the reverse control which enables the reverse circuit and disables the forward circuit, is activated and the motor is driven in reverse direction to drive the valve to its reverse limit position. Upon reaching reverse limit position, limit switch 38 disables the reverse circuit and the controller remains in this condition until the next energization of the forward circuit. This cyclic operation of energizing first the forward circuit and then the reverse circuit continues, with the controller and pilot valve 32 remaining in either forward or reverse position until the subsequent energization of the reverse or forward circuit, respectively.

Figure 2:
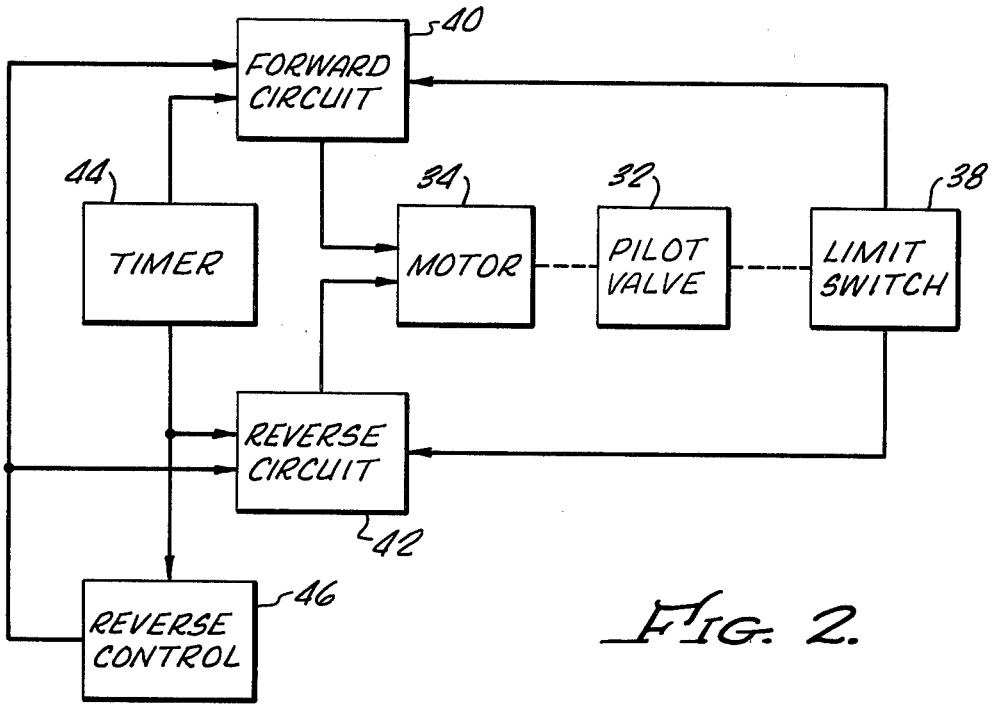
FIG. 2 is a functional block diagram of a time regulated controller embodying principles of the present invention.
Figure 3:
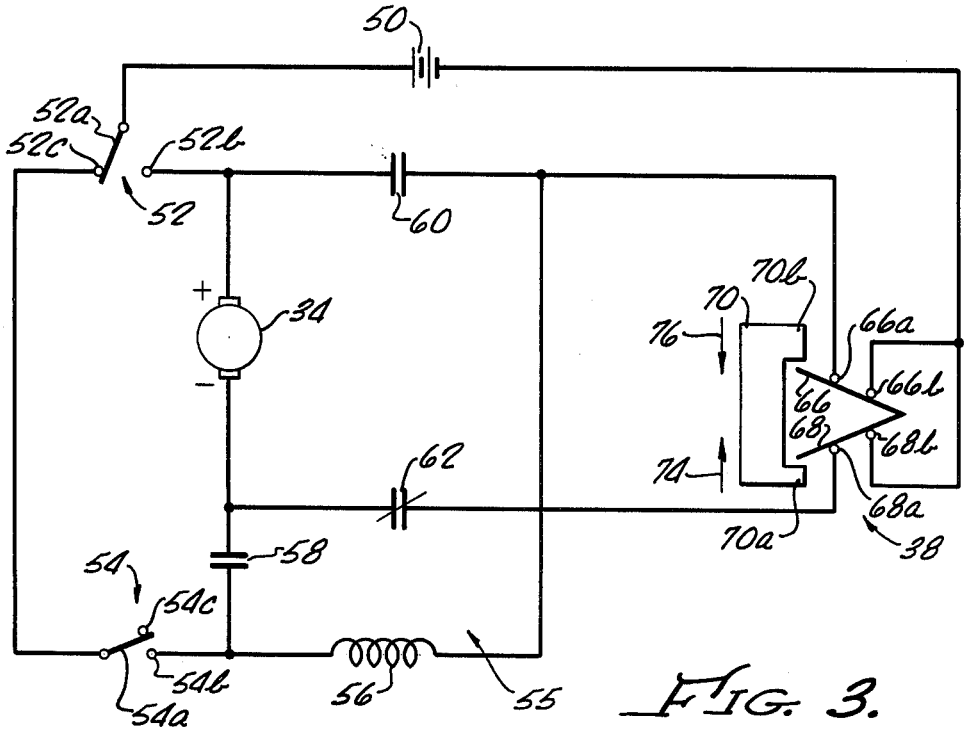
FIG. 3 is a circuit diagram of the controller of FIGS. 1 and 2.
Figure 5:
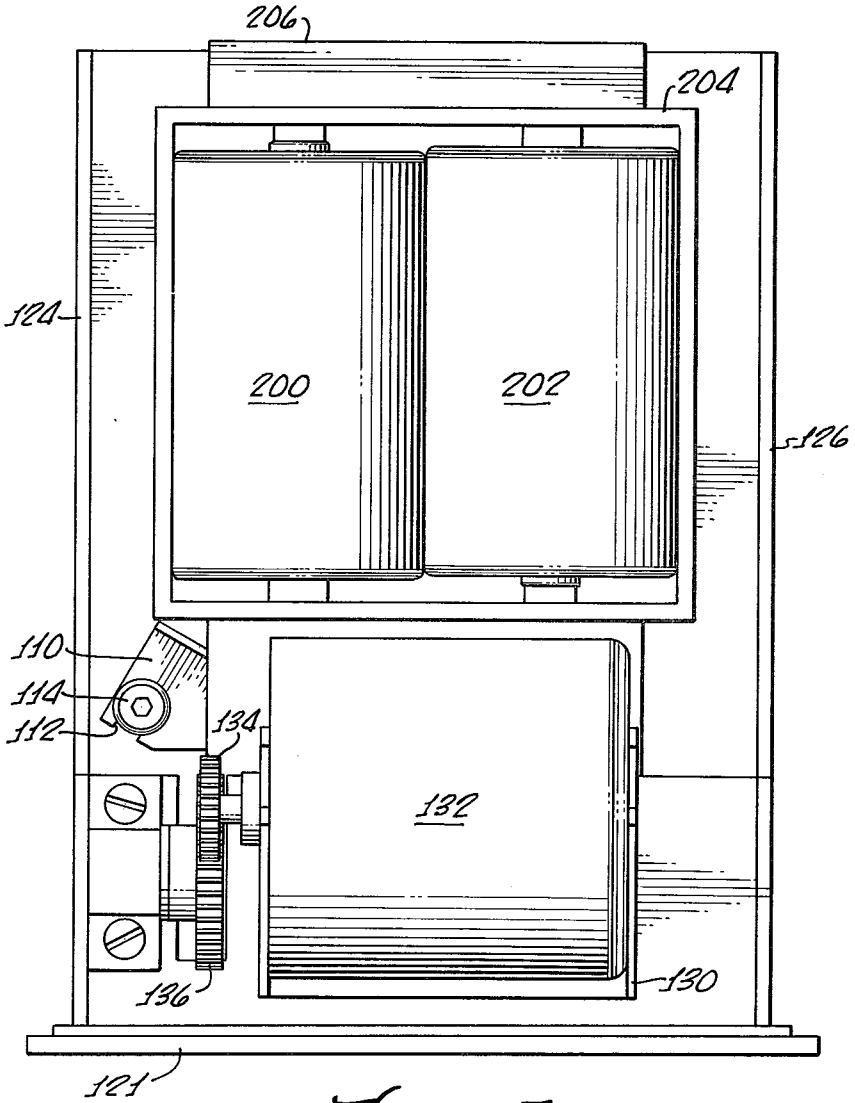
FIG. 5 is a rear elevation view of the apparatus of FIG. 4.

A circuit of the functional block diagram of FIG. 2 is shown in FIG. 3 as including a battery 50, first and second timer operated switches 52, 54, and a motor reversing relay 55 having a coil 56, first and second sets of normally open contacts 58, 60, and a set of normally closed contacts 62. Switches 52, 54 include movable contact arms (switch operators) 52*a*, 54*a* and switch contacts 52*b*, 52*c*, and 54*b*, 54*c*. These switches are enabling switches for the respective motor control circuits. The valve operated limit switch 38 comprises a normally closed dual double pole switch having pairs of contacts 66*a*, 66*b* and 68*a*, 68*b* and contact arms (operators) 66, 68 that are connected to be operated by an actuator 70 that is mounted for motion with the valve spool. All switches are shown in FIG. 3 in normally unoperated condition and may be moved from this condition to an opposite condition upon engagement by a suitable actuator. All return to unoperated condition upon release of such engagement.

A timer, to be described below, includes timer actuators positioned to sequentially actuate switch operators 52*a* and 54*b* of switches 52 and 54, respectively, in a timed sequence. Initially, operator 52*a* is actuated to move this operator from its normal engagement with contact 52*c* into engagement with switch contact 52*b*, thereby to energize the forward motor control circuit. Relay coil 56 is de-energized at this time and its contacts are in the conditions illustrated in FIG. 3, with contacts 58 and 60 being open and contact 62 being closed. A circuit is thus completed from the battery 50 through the switch 52 and contact 52*b*, through the motor from the positive side of the motor to the negative side of the motor, thence through closed relay contacts 62, through normally closed limit switch contacts 68*a* and 68*b* and thence back to the battery 50. The forwardly energized motor drives the valve spool together with limit switch actuator 70 in a direction, such as indicated by arrow 74 of FIG. 3, until a first leg 70*a* of actuator 70 contacts limit switch operator 68 and opens the contacts 68*a* and 68*b*. The forward motor circuit is thereby de-energized and the controller will remain in this condition with the valve spool at its forward limit. The first timer actuator will disengage from switch operator 52*a* and this operator will return to the position illustrated in FIG. 3, thus providing an additional open switch (in addition to the now open limit switch contacts 68*a*, 68*b*) in the forward motor circuit. No circuits are complete at this time and the valve spool and limit switch remain in this position until the next operation commanded by the timer.

A second actuator of the timer will subsequently engage arm 54*b* of switch 54. Switch 54, when operated, energizes the reverse motor control circuit and also energizes the coil 56 of reverse control 46. Upon energization of coil 56, contacts 62 open and contacts 58 and 60 close. The reverse motor control circuit is now completed from the battery 50 through contact 52*c* of switch 52 (which is disengaged from its timer actuator pin), through contact 54*b* and operator 54*a* (which is engaged by its timer actuator pin and thus moved from the illustrated position thereof), through closed contacts 58, through the motor from the negative to the positive side thereof, through closed contacts 60, through closed limit switch contacts 66*a* and 66*b* and back to the battery.

Relay coil 56 is energized from the battery via switches 52 and 54, through the coil, thence through closed limit switch contacts 66*a* and 66*b* and back to the battery. The motor drives the valve spool in reverse, moving limit switch actuator 70 in the opposite direction, as indicated by arrow 76 of FIG. 3, until another actuator leg 70*b* of the actuator engages the other limit switch arm 66 to disconnect contacts 66*a* and 66*b* and thereby de-energize the reverse motor control circuit and the relay coil 56. The valve spool and limit switches remain in this condition, at the limit of reverse movement of the spool until the next timer commanded operation.

As the timer continues, switch operator 54*a* is disengaged from the second timer actuator pin, operator 54*a* returns to contact 54*c*, and the circuit returns to the condition illustrated in FIG. 3, except for the fact that limit switch actuator 70 is in a lower limit position and contacts 66*a* and 66*b* remain disconnected. Thus no circuits are energized, no current is drawn and the timer is in a mechanically and electrically stable condition where it remains until the next energization of the forward motor control circuit.

Relay contacts 58, which are normally open, prevent energization of the relay coil 56 upon initial operation of switch 52. Normally open contacts 60 prevent a short circuit that would bypass the motor when switch 52 is operated and limit switch contacts 66*a* and 66*b* are closed. Similarly, contacts 62, which are open when the reverse motor control circuit is energized, prevent a short circuit through switches 52, 54, closed contacts 58 and the limit switch when contacts 68*a* and 68*b* are closed.

Figure 10:
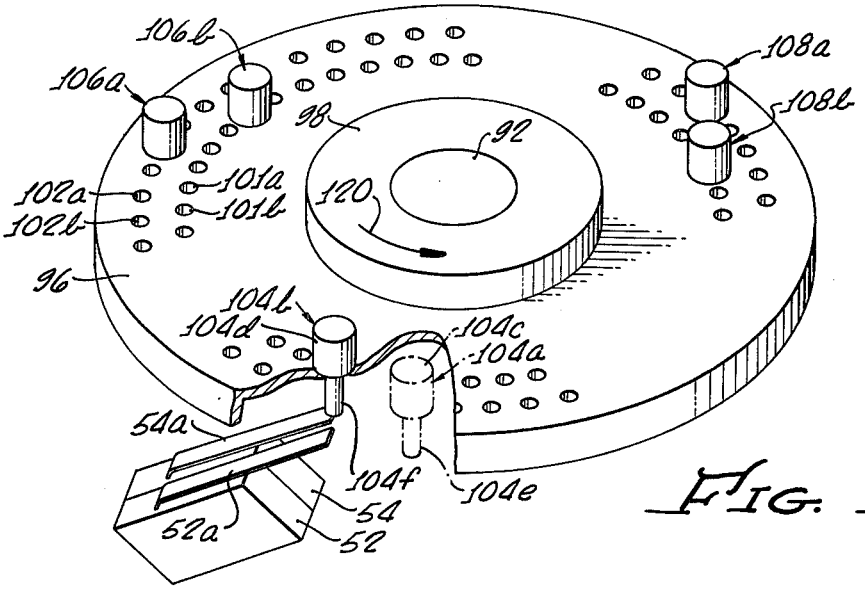
FIG. 10 is a perspective view illustrating the relation of the timer dial actuator pins and snap action switches.
Figure 4:
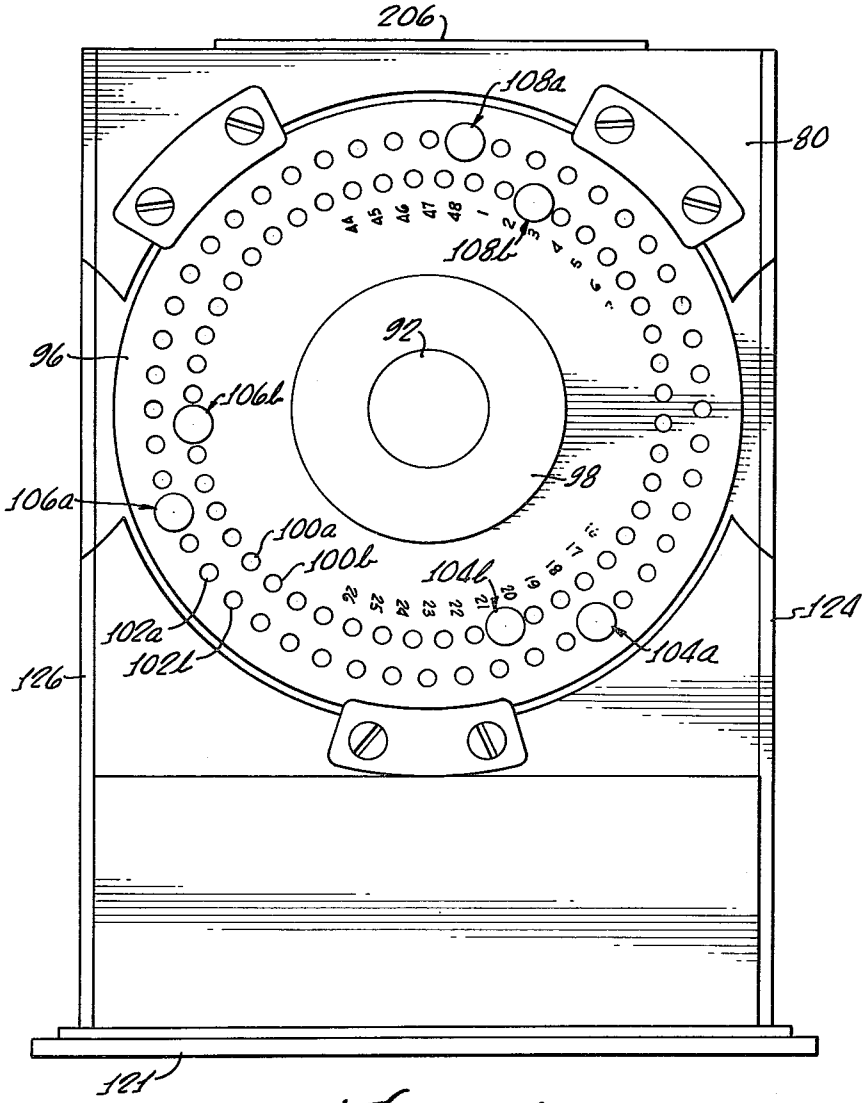
FIG. 4 is a front elevation of an exemplary mechanization of the controller of this invention.

A compact package containing the described time regulated controller elements is shown in FIGS. 4–14. A control housing 80 carries a battery operated clock mechanism 82, having an output shaft 84 to which is fixed a driving gear 86 engaging an idler gear 88 that is journalled to the housing 80. A dial pulley 90 having a hub 92 is journalled to the housing 80 and entrains a driving belt 94 which also passes over a driving pulley 95 fixedly carried by gear 88. A clock dial or actuator carrier 96 has a hub 98 pressed upon the pulley hub 92 for rotation therewith. Dial 96 has first and second radially displaced circumferentially extending rows of time control holes such as holes 100*a*, 100*b*, etc. and 102*a* and 102*b*, etc. (FIGS. 4 and 10). Pairs of headed actuator pins 104*a*, 104*b*, 106*a*, 106*b* and 108*a*, 108*b*, are selectively and adjustably mounted in different ones of the apertures. Each pin has an enlarged head such as 104*c*, 104*d*, and a smaller shank such as 104*e*, 104*f*, of a size or diameter to be closely and snugly received in one of the apertures of the circumferential rows on the dial 96.

The timer operated switches 52 and 54 are fixed in side-by-side relation to a switch bracket 110 that is mounted to the controller housing by means of an elongated slot 112 and a bolt 114. Thus the bracket and the switches are adjustable along the length of the elongated slot 112 and about the axis of bolt 114. The switches have operator arms 52*a* and 54*a*, respectively, that extend beyond the switch bodies at an angle to and intersecting the circular paths of motions of the respective actuator pin shanks such as shank 104*e* and shank 104*f*. Thus, as the dial rotates in the direction indicated by arrow 120 of FIG. 10, switch 52 is first operated by an actuator pin in an outer row of holes. After engagement of the operator arm of this switch has been released, the inwardly positioned switch 54 has its arm 54*a* engaged by the shank of a pin inserted in the inner row of holes. Preferably the pins of any pair of pins in the inner and outer rows, such as the pins 104*a* and 104*b*, are circumferentially spaced so that the engagement of any actuator pin with its respective switch actuator arm will occur a minimum of about fifteen to thirty minutes after the engagement of a switch operator arm with an actuating pin of the other row. In other words, each of the switches 52 and 54 is operated only after engagement and operation of the other switch has been terminated. This arrangement minimizes drag or resistance to dial rotation and allows use of miniature snap action switches having operator arms only temporarily depressed by the actuator pins and thus readily released as the actuator pins ride over the switch operators and out of engagement therewith.

A pilot spool body 122 is fixed to a base 121, and is also fixed to and below the control housing 80 by means of side plates 124, 126 which are bolted to both the housing 80 and the spool valve body 122. Fixed to the body 122 is a motor support bracket 130 which adjustably carries a miniature spool driving motor 132. The motor fixedly carries a gear 134 that meshes with an idler gear 136.

Valve body 122 is formed with a longitudinal bore 138 (FIG. 7) in which is slidably mounted an elongated valve spool 140 having enlarged diameter closure cylinders 142, 144 mutually spaced from each other by a smaller diameter shaft member 146 to define with the valve body a valve chamber 148. Valve spool closure cylinders 142 and 144 are each flanked by a pair of sealing O-rings 149, 150, 151, 152.

Figure 7:
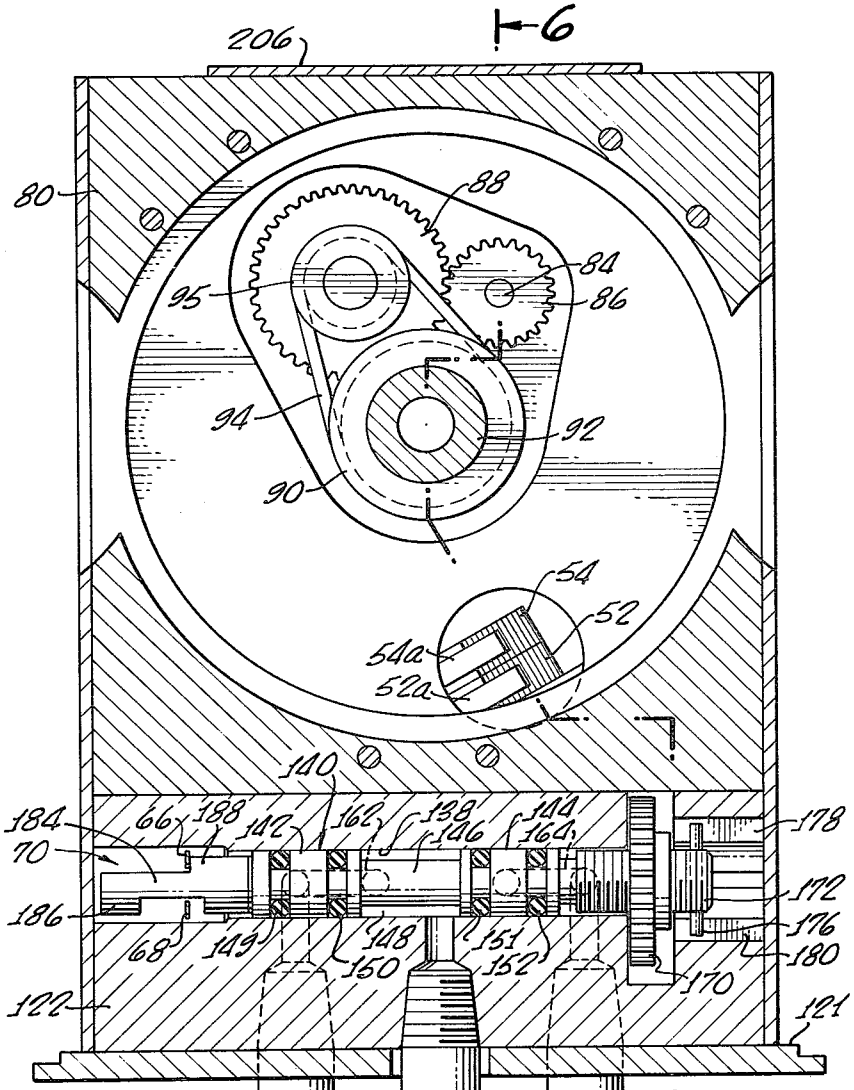
FIG. 7 is a sectional elevation view taken on line 7—7 of FIG. 6.
Figure 6:
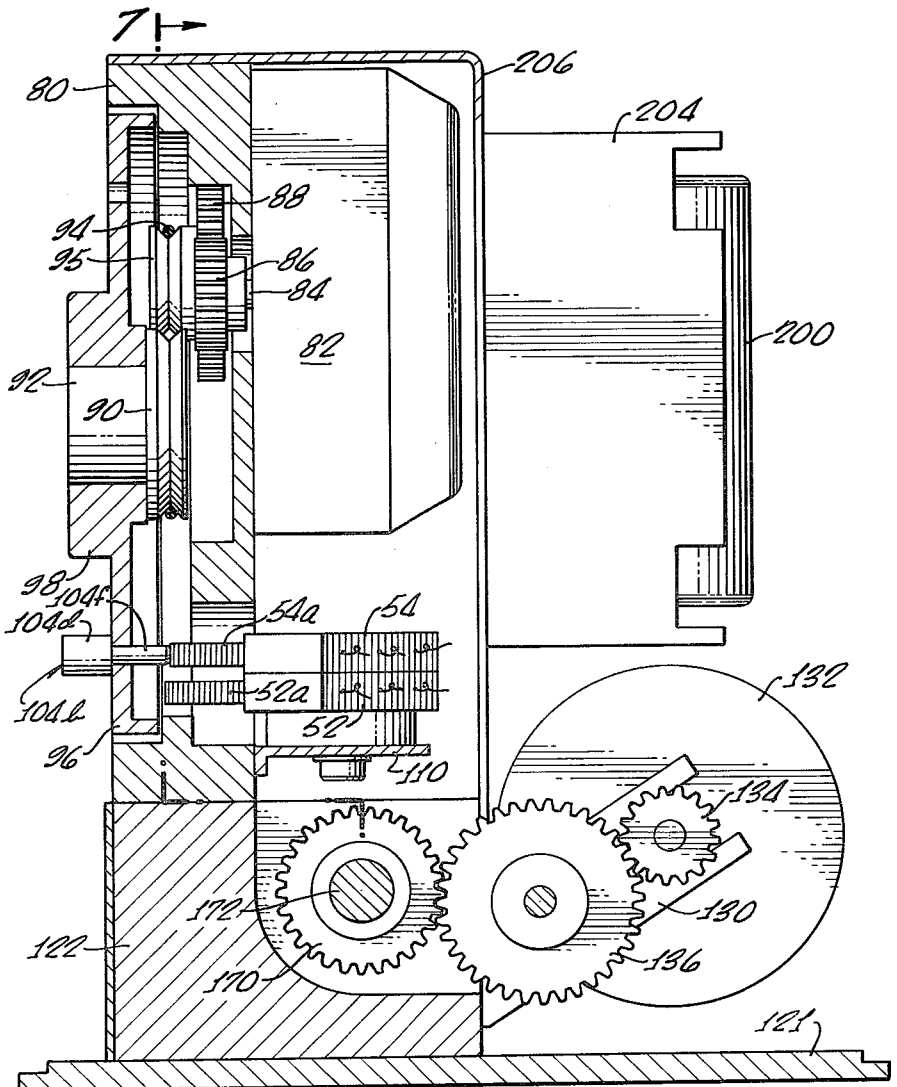
FIG. 6 is a sectional elevation view of the apparatus of FIG. 4 taken on line 6—6 of FIG. 7.
Figure 9:
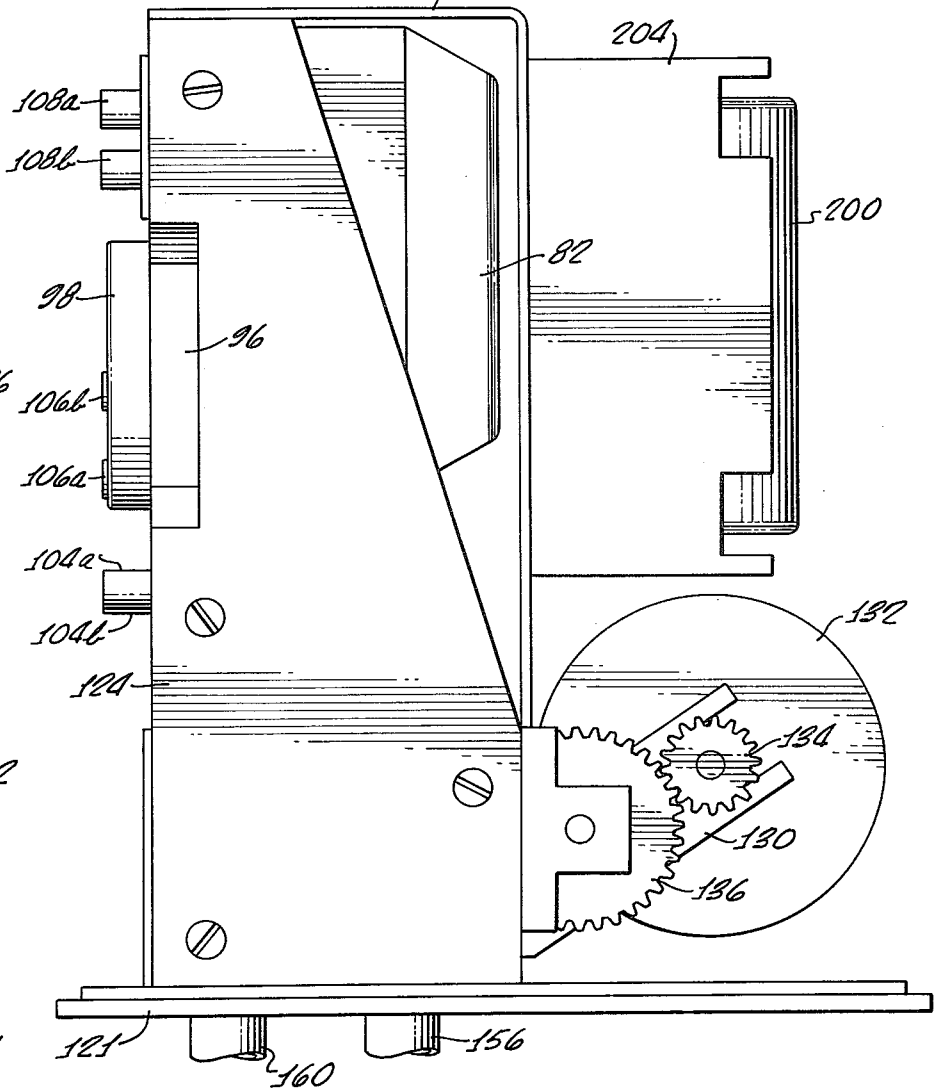
FIG. 9 is a side elevation view.
Figure 8:
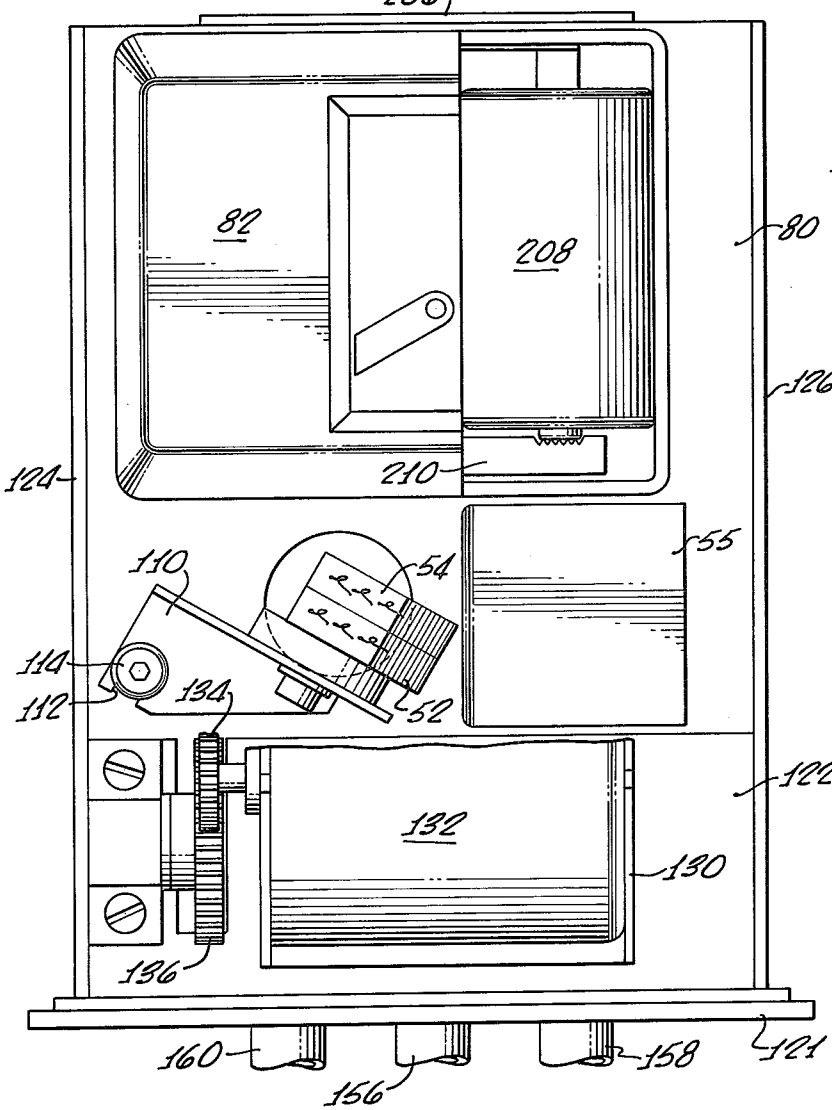
FIG. 8 is a rear elevation view, with parts broken away.
Figure 11:
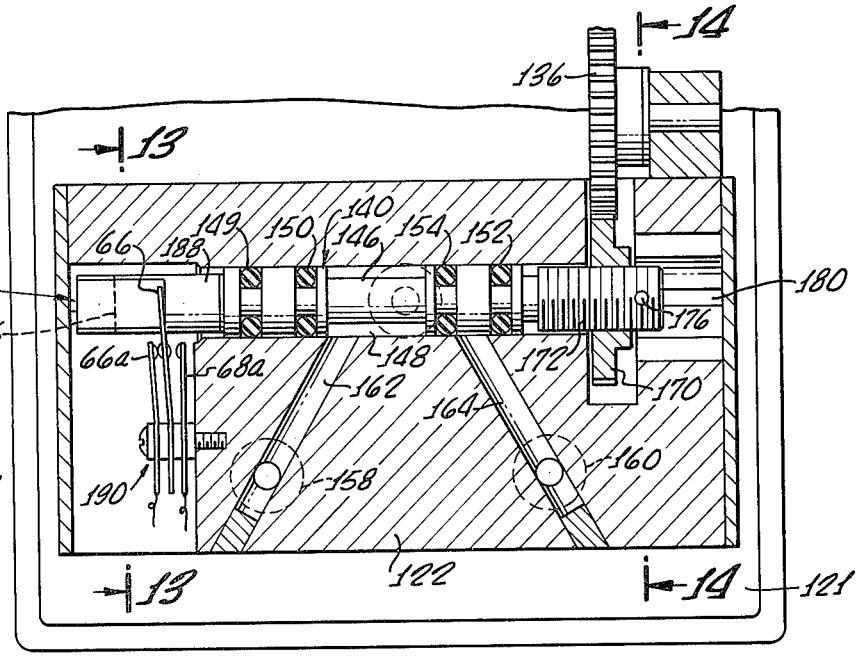
FIG. 11 is a horizontal sectional view showing the pilot valve spool and limit switches in one position.
Figure 12:
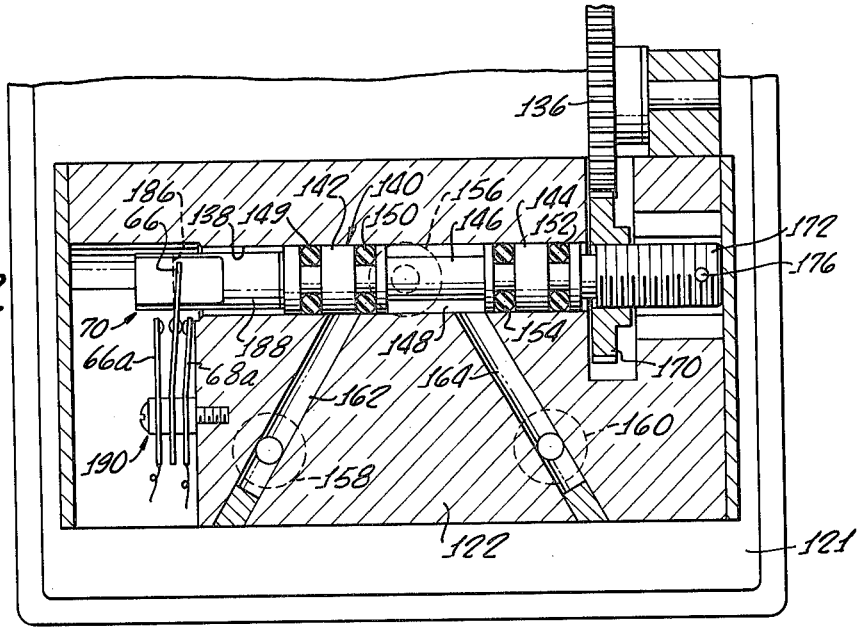
FIG. 12 is a view similar to FIG. 11 showing the pilot valve spool and limit switches in another position.
Figure 13:
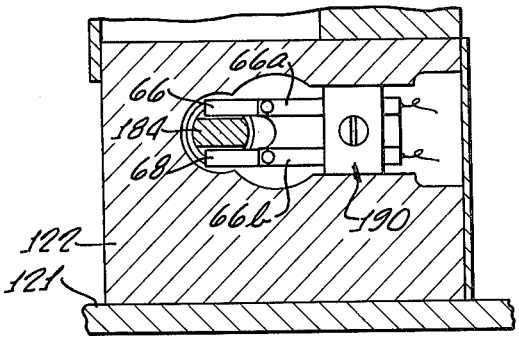
FIGS. 13 and 14 are sectional views taken on lines 13—13 and 14—14, respectively, of FIG. 11.
Figure 14:
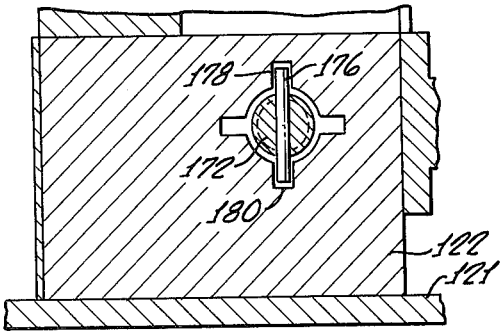

Valve body 122 is provided with common, drain and pressure ports respectively designated at 156, 158 and 160, which extend through the bottom of the controller. Drain and pressure ports 158 and 160 communicate with the valve spool bore 138 by means of laterally extending conduits 162 and 164 (FIGS. 11, 12) formed in the valve body. Common port 156 extends directly upwardly from the bottom of the controller to the chamber 148. The several ports and conduits are positioned with respect to the valve spool closure cylinders so that the common and drain ports 156, 158 are in fluid communication with each other when the valve spool is moved toward the left as illustrated in FIGS. 7 and 11. These ports and closure cylinders are so positioned that the common and pressure ports, 156, 160, are in fluid communication with each other when the valve spool is at its other limiting position, toward the right as illustrated in FIG. 12. In the one position of FIGS. 7 and 11, the pressure port 160 is blocked by closure cylinder 144 whereas in the opposite position, as illustrated in FIG. 12, the drain port 158 is blocked by pressure cylinder 142.

A spool driving gear 170 is internally threaded and threadedly engaged with an end 172 of the valve spool which itself is externally threaded. The threaded end 172 of the valve spool is fixed to the valve, preferably formed integrally therewith, and carries a fixed keying pin 176 (FIG. 14) that extends diametrically of and projects from the valve spool. The keying pin rides in longitudinally extending, diametrically opposed keying slots 178, 180 formed in the valve body 122.

Gear 170 meshes with the motor driven idler gear 136, whereby the valve spool may be driven in one direction or the other by rotation of the motor in one direction or the other to thereby rotate the driving gear 170 and effect translation (without rotation) of the keyed valve spool along its axis. Thus, the valve spool is reciprocally driven by the reversing motor and the interconnecting gear train.

Moving with the valve spool is the limit switch actuator 70 which includes an elongated body portion 184 having a first actuating leg 186 laterally protruding from the body at one end thereof and having a second actuating leg 188 laterally protruding from the body at the other end thereof. The limit switch actuator 70 is fixed to the end of the valve spool remote from the valve driving gear 170 for motion together with the valve spool. Preferably, adjoining ends of the actuator 70 and the valve spool are provided with equal diameter and mutually aligned apertures in which the opposite ends of an interconnecting pin (not shown) are press fit. Obviously many other means of fixedly connecting the limit switch actuator to the valve spool may be employed.

The limit switch actuator cooperates with a dual normally closed double pole switch (FIGS. 11, 12, 13) comprising a first pair of contacts 66*a*, 66*b* and a second pair of contacts 68*a*, 68*b*, of which only contacts 66*a* and 68*a* are shown in FIGS. 11 and 12. Contacts 66*a*, 66*b* and 68*a*, 68*b* are mounted on flexible fingers which in turn are secured to the valve body 122 in an electrically non-conductive mounting block 190. Interposed between the flexible fingers of contacts 66*a*, 66*b*, 68*a* and 68*b* are a pair of side-by-side flexible limit switch operator arms 66 and 68, which are physically and electrically interconnected with each other and adapted to electrically engage all of the contacts 66*a*, 66*b*, 68*a* and 68*b* in normal, unoperated position of this dual switch.

As the valve spool moves to the leftmost limit position, as seen in FIGS. 7 and 11, limit switch actuator leg 188 engages operator arm 66 and moves this arm together with the arm 68, connected thereto, to the left. This disconnects contacts 68*a* and 68*b* from each other. When the valve spool reaches its limit position as it moves toward the right (the position shown in FIG. 12), limit switch actuator leg 186 engages arm 168 and moves this arm together with arm 66, connected therewith, toward the right, out of engagement with contacts 66*a* and 66*b*, thus disconnecting these contacts from each other and opening this part of the limit switch. In intermediate positions of the valve spool, between its extreme or limit positions, the limit switch actuator may completely disengage from the limit switch operator arms 66, 68 and thus both of the double pole limit switches will be closed in such intermediate positions.

A pair of batteries 200, 202 (FIG. 5) for driving the motor 132 are mounted in a battery frame 204 that is secured to and extends forwardly to provide a top 206 for the housing.

A single battery 208 (FIG. 8) is mounted to the housing in a bracket 210 and the relay 55, including the relay coil and all of its contacts in a single conventional relay package, is mounted to the housing alongside of the snap switches 52, 54 and below the clock battery 208.

To recapitulate operation of the described controller, a time program for control of the automatic valve 14, 16 is set by positioning of any desired number of pairs of pins in the inner and outer rows of holes of the dial 96. Preferably the circuit is arranged so that pins inserted in the outer rows will open the valve 14, 16 by connecting the common and drain ports of the pilot valve, and pins in the inner row of holes of the dial will close the valve 14, 16 by interconnecting the common and pressure ports of the pilot valve. The timer may be programmed for a number of sequences of on/off operations within a single timer cycle. In an exemplary embodiment the timer dial will move through one full revolution in 48 hours and thus the three pairs of actuator pins will open and close the valve 14, 16 three times in each 48-hour period. As previously mentioned, the actuator pins are preferably set no closer to each other than time intervals of fifteen to thirty minutes. As the timer rotates, an outer row pin, such as actuator pin 104*a*, will operate switch 52 to energize the forward motor control circuit, thus driving the pilot valve spool to the left (as viewed in FIG. 11). The motor is energized in a forward direction and rotates gear 170 on its threaded engagement with the end of the pilot spool, whereby the latter is driven to the left until it reaches the leftmost limit position of FIG. 11. In this position the limit switch actuator leg 188 has engaged the switch arm 66 and both this flexible arm and the flexibly mounted contacts 68*a* and 68*b* are moved to the left, thereby disconnecting contacts 68*a* and 68*b* to break the forward motor circuit. Switch operator arm 52*a* may still be engaged by the actuator pin but the timer nevertheless remains in this position and continues in this position even after the actuator pin 104 drops off the operator arm 52*a*.

No further change in the circuit or pilot valve occurs until the next actuator pin 104*b* of the inner row contacts operator arm 54*a* to close this switch and energize both the reverse motor circuit and the relay coil 56. The contacts of the latter rapidly switch and the motor is driven in reverse direction. The pilot valve spool is driven in the other direction, to the right as viewed in FIG. 7, until it reaches the reverse limit position illustrated in FIG. 12. It will be noted that before the limit switch actuator reaches the reverse limit position, contacts 68*a* and 68*b* are closed but because relay contacts 62 (FIG. 3) are open in this reverse driving position, no current will flow through these contacts. In the reverse limit position the limit switch actuator is driven from its engagement with contacts 66*a* and 66*b* to break the motor driving circuit and all of the timer control elements remain in this position. When the inner pin 104*b* drops off the operator arm of switch 54, this switch opens, the relay coil is de-energized and its contacts return to their illustrated positions, but no further action occurs. The pressure and common ports of the pilot valve remain connected to maintain pressure in the automatic valve chamber 22 to keep the valve 14, 16 in closed condition until the next cycle of opening and closing is commanded by the next pair of pins 106*a* and 106*b*. This sequential opening and closing continues under control of the successive pairs of pins as long as electrical power is available to the clock and motor.

There has been described a compact, miniaturized self-contained timed controller providing several states of actuation and which is self-latching to remain in each actuation state until driven from such state by the next program command.

The foregoing detailed description is to be clearly understood as given by way of illustration and example only, the spirit and scope of this invention being limited solely by the appended claims.

What is claimed is:

1. A timed controller comprising a valve body having a plurality of ports, a valve spool mounted in said body for motion between a first position in which the spool interconnects a first pair of said ports and a second position in which the spool interconnects a second pair of said ports, a reversible motor connected to drive said valve spool between said first and second positions, first and second motor control circuits for driving said motor in first and second directions respectively and each including an enabling switch, first timer controlled means for operating said enabling switch of said first motor control circuit, limit switch means responsive to said valve spool for de-energizing said first motor control circuit, reversing means for establishing said second motor control circuit, second timer controlled means for operating said enabling switch of said second motor control circuit at a time selectively delayed from the de-energization of said first motor control circuit, and limit switch means responsive to said valve spool for de-energizing said second motor control circuit.

2. The controller of claim 1 wherein said second timer controlled means comprises means for concommitantly energizing said reversing means.

3. The controller of claim 1 wherein said reversing means includes means responsive to said second timer controlled means for breaking said first motor control circuit and wherein each of said timer controlled means includes means for de-energizing its respective circuit shortly after energization thereof.

4. A timed controller comprising a valve body having a plurality of ports, a valve spool mounted in said body for motion between a first position in which the spool interconnects a first pair of said ports and a second position in which the spool interconnects a second pair of said ports, a reversible motor connected to drive said valve spool between said first and second positions, first and second motor control circuits for driving said motor in first and second directions respectively, first timer controlled means for energizing said first motor control circuit, limit switch means responsive to said valve spool for de-energizing said first motor control circuit, reversing means for establishing said second motor control circuit, second timer controlled means for energizing said second motor control circuit, limit switch means responsive to said valve spool for de-energizing said second motor control circuit, said first and second timer controlled means comprising a clock driven actuator carrier, first and second actuators mounted to said carrier, for motion along first and second mutually displaced paths respectively, first and second enabling switches in said first and second motor control circuits respectively, said first and second enabling switches each having an operator arm positioned in an individual one of the paths of said actuators.

5. The controller of claim 4 wherein said actuators include a plurality of first actuators mounted to said carrier for motion along said first path and a plurality of second actuators mounted to said carrier for motion along said second path, said actuators being staggered in said first and second paths whereby said first and second enabling switches are alternately operated by one of said first actuators and one of said second actuators.

6. An automatic self-cycling timer controlled valve comprising a valve body, a valve spool movably mounted in the body, reversible motor means for driving said spool in one direction or another, first and second motor circuit means for energizing said motor in first and second directions respectively, timing means for automatically and cyclically enabling said first and second circuit means at times respectively delayed by selected time intervals after disablement of the other of said circuit means, and (a) limit switch means comprising limit means responsive to attainment of a first position by said valve spool for disabling one of said motor circuit means, and limit means responsive to attainment by said spool of a second position for disabling said other circuit means.

7. The valve of claim 6 wherein said last mentioned limit means comprises means for enabling said one circuit means when said other circuit means is disabled.

8. The valve of claim 6 wherein said last mentioned limit means includes a relay having a coil in said other circuit and a set of relay contacts in said one circuit, whereby said one circuit is enabled when said other circuit is disabled.

9. The valve of claim 6 wherein said timing means comprises means for releasing the disabling of at least one of said circuit means by said timing means after a period of enablement thereof.

10. The valve of claim 6 wherein motor circuit means are normally disabled and wherein said timing means includes means for terminating the enabling of said first circuit means before said second circuit means is enabled.

11. The valve of claim 10 including motor reversing means comprising a relay having first and second sets of contacts in said first and second motor circuit means respectively, and having a relay coil, and means responsive to said timing means for energizing said coil when said second motor circuit means is enabled and for enabling said first motor circuit means without energizing said relay coil.

12. A timer controlled valve comprising a valve body, a valve spool movably mounted in the body, a reversible motor for driving said spool in one direction or another, first and second motor circuit means for energizing said motor in first and second directions respectively, timing means for sequentially enabling said first and second circuit means, a limit switch comprising limit means responsive to attainment of a first position by said valve spool for disabling one of said motor circuit means, and limit means responsive to attainment by said spool of a second position for disabling said other circuit means, said first circuit means including a power supply, a first enabling switch and a first pair of relay contacts connected in circuit with said motor, said second circuit means including a power supply, a second enablinhg switch and a second pair of relay contacts connected in circuit with said motor, a relay coil coupled with said contacts and connected in circuit with said last mentioned power supply and said second switch, and said timing means comprising first and second switch actuators positioned to operate said first and second enabling switches at mutually different times.

13. The valve of claim 12 wherein said first and second enabling switches each comprises a switch operator, normally open contacts and means for urging said contacts to normally open position, said timing means comprising a clock driven actuator carrier and first and second switch actuators adjustably positioned upon and carried by said carrier for motion through first and second mutually displaced actuator paths, said enabling switch operators being respectively mounted in said first and second actuator paths, whereby said switch operators are temporarily engaged by said switch actuators to move the switch contacts from normally open position and said contacts are returned to said normally open position when said switch operators are disengaged from said switch actuators.

14. The valve of claim 6 wherein said limit switch means comprises a first limit switch in said first motor circuit means, a second limit switch in said second motor circuit means, and a limit switch actuator fixed to said valve spool, said limit switch actuator including a first actuator leg connected to operate said first limit switch as said valve spool moves in a first direction and a second actuator leg connected to actuate said second limit switch as said valve spool moves in an opposite direction.

15. The valve of claim 14 wherein said first and second limit switches include a common limit switch operator connected to normally close both of said limit switches, said limit switch actuator being movable together with said valve spool along a predetermined path, said common limit switch operator including a portion extending into said limit switch actuator path and positioned to be driven in one direction by said first actuator leg and in an opposite direction by said second actuator leg.

16. The valve of claim 6 wherein said valve spool comprises an elongated body having an externally threaded portion, said reversible motor means for driving said spool comprising a gear having an internally threaded hub threadedly engaged with said threaded valve spool portion, said motor means comprising a motor and gearing interconnecting said motor and said spool driving gear, and means for restraining rotation of said valve spool.

17. A timer controlled valve comprising a valve body having a plurality of valve ports therein, a valve chamber within said valve body and in communication with said valve ports, a valve spool movably mounted for motion within said chamber to selectively block and unblock different ones of said ports, a reversible motor, means for connecting said motor to drive said valve spool in one direction or another, a limit switch actuator connected with said valve spool for motion therewith, first and second limit switches, said limit switch actuator including first and second actuator legs connected to operate said first and second limit switches respectively as said valve spool moves to first and second positions respectively, first and second circuits for respectively energizing said motor for operation in one direction or another, said first and second limit switches being connected in said first and second circuits respectively, timing means for sequentially enabling said first and second circuits, one after the other, said timing means comprising a timer dial, first and second actuators carried by said dial for motion in first and second mutually displaced paths, first and second enabling switches respectively connected in said first and second circuits, said enabling switches including first and second enabling switch operators positioned in said first and second paths respectively.

18. The valve of claim 17 including a relay having a coil connected to be energized upon operation of one of said enabling switches and having a first set of contacts in said first circuit and a second set of contacts in said second circuit.

19. The valve of claim 17 wherein said first and second enabling switches include means for urging such switches to circuit disabling position and wherein said enabling switch operators are positioned to be temporarily actuated by said actuators of said timer dial, whereby each of said enabling switches is closed upon contact with one of said switch actuators and is opened as such switch actuator moves from a position of contact therewith.

20. A timed controller comprising a valve body having a plurality of ports, a valve spool mounted in said body for motion between a first position in which the spool interconnects a first pair of ports and a second position in which the spool interconnects a second pair of ports, a reversible motor connected to drive said valve spool between said first and second positions, first and second motor control circuits for driving said motor in first and second directions respectively, first timer controlled means for energizing said first motor control circuit, limit switch means responsive to said valve spool for de-energizing said first motor control circuit, second timer controlled means for energizing said second motor control circuit, limit switch means responsive to said valve spool for de-energizing said second motor control circuit, motor reversing means operable between a first condition for establishing said first motor control circuit and a second condition for establishing said second motor control circuit and breaking said first motor control circuit, said second timer controlled means including means for operating said motor reversing means between said first and second conditions, said first and second timer controlled means comprising first and second enabling switches connected in said first and second motor control circuits respectively, and a timer driven actuating means for sequentially actuating said enabling switches.

21. The controller of claim 20 wherein said spool is elongated and has an externally threaded portion, said spool being axially movable within said body, means for restraining rotation of said spool, a spool gear threaded upon said spool threaded portion, and a driving gear meshing with said spool gear and connected to be driven by said motor.

22. The controller of claim 20 wherein said motor reversing means comprises a relay having a first set of contacts in said first motor control circuit, a second set of contacts in said second motor control circuit and a coil connected to be energized by said second timer controlled means.

23. A timed controller comprising a valve body having a plurality of ports, a valve spool mounted in said body for motion between a first position in which the spool interconnects a first pair of ports and a second position in which the spool interconnects a second pair of ports, a reversible motor connected to drive said valve spool between said first and second positions, first and second motor control circuits for driving said motor in first and second directions respectively, first timer controlled means for energizing said first motor control circuit, limit switch means responsive to said valve spool for de-energizing said first motor control circuit, second timer controlled means for energizing said second motor control circuit, limit switch means responsive to said valve spool for de-energizing said second motor control circuit, motor reversing means operable between a first condition for establishing said first motor control circuit and a second condition for establishing said second motor control circuit and breaking said first motor control circuit, said second timer controlled means including means for operating said motor reversing means between said first and second conditions, said motor reversing means comprising a relay having a first set of contacts in said first motor control circuit, a second set of contacts in said second motor control circuit and a coil connected to be energized by said second timer controlled means, said first and second timer controlled means comprising a timer driven actuator carrier, first and second actuators mounted to said carrier for motion through first and second paths, and first and second enabling switches connected in said first and second motor control circuits respectively and having respective enabling switch operators positioned in said first and second paths.

* * * * *